US008780143B2

(12) United States Patent
Keh et al.

(10) Patent No.: US 8,780,143 B2
(45) Date of Patent: Jul. 15, 2014

(54) DISPLAY METHOD AND APPARATUS FOR CONTROLLING BRIGHTNESS OF PROJECTOR LIGHT SOURCE

(75) Inventors: Yong-Chan Keh, Seongnam-si (KR); Sung-Won Kim, Suwon-si (KR); Ho-Min Lee, Suwon-si (KR); Byeong-Hoon Park, Suwon-si (KR); Jung-Kee Lee, Osan-si (KR); Sung-Sun Kim, Seoul (KR)

(73) Assignee: Samsung Electronics Co., Ltd (KR)

( * ) Notice: Subject to any disclaimer, the term of this patent is extended or adjusted under 35 U.S.C. 154(b) by 979 days.

(21) Appl. No.: 12/708,938

(22) Filed: Feb. 19, 2010

(65) Prior Publication Data

US 2010/0207956 A1 Aug. 19, 2010

(30) Foreign Application Priority Data

Feb. 19, 2009 (KR) ..... 10-2009-0014117
Jul. 15, 2009 (KR) ..... 10-2009-0064642

(51) Int. Cl.
*G09G 5/10* (2006.01)
*G09G 5/02* (2006.01)

(52) U.S. Cl.
USPC ..... 345/690; 345/589

(58) Field of Classification Search
CPC ..... G09G 5/02; G09G 2320/0666; G09G 2360/16; G09G 2320/0626; G09G 3/3406; G09G 2350/0646; G09G 3/3413; G06T 5/40
See application file for complete search history.

(56) References Cited

U.S. PATENT DOCUMENTS

| | | | | |
|---|---|---|---|---|
| 6,894,697 | B2 * | 5/2005 | Matsuda | 345/589 |
| 2005/0017990 | A1 * | 1/2005 | Yoshida | 345/690 |
| 2005/0104841 | A1 * | 5/2005 | Sohn et al. | 345/102 |
| 2005/0231457 | A1 | 10/2005 | Yamamoto et al. | |
| 2006/0119612 | A1 * | 6/2006 | Kerofsky et al. | 345/590 |
| 2006/0279710 | A1 * | 12/2006 | Tani | 353/85 |
| 2007/0063961 | A1 * | 3/2007 | Kuroki | 345/102 |
| 2008/0094346 | A1 * | 4/2008 | De Greef | 345/102 |
| 2008/0117160 | A1 | 5/2008 | Oka et al. | |
| 2008/0143736 | A1 | 6/2008 | Clatanoff et al. | |
| 2008/0204396 | A1 | 8/2008 | Otome | |

FOREIGN PATENT DOCUMENTS

| | | |
|---|---|---|
| JP | 2008-129251 | 6/2008 |
| JP | 2008-216560 | 9/2008 |
| KR | 1020060124132 | 12/2006 |
| KR | 1020080080040 | 9/2008 |
| WO | WO 03/094138 | 11/2003 |

* cited by examiner

*Primary Examiner* — Carlos Perromat
(74) *Attorney, Agent, or Firm* — The Farrell Law Firm, P.C.

(57) ABSTRACT

A method of displaying image data is provided, which includes analyzing histograms by color signals of an input image frame; confirming grayscales by color signals in a predetermined frame unit with reference to the analyzed histograms; determining dimming factors in consideration of maximum grayscale values of the grayscales; determining image gains of the image data by color signals using the determined dimming factors; and outputting an image signal by applying the image gains to the input image and applying the dimming factors to a light source.

15 Claims, 8 Drawing Sheets

DISPLAY METHOD AND APPARATUS FOR CONTROLLING BRIGHTNESS OF PROJECTOR LIGHT SOURCE

This application claims priority under 35 U.S.C. §119(a) to Korean Patent Applications filed in the Korean Intellectual Property Office on Feb. 19, 2009 and Jul. 15, 2009 and assigned Serial Nos. 10-2009-0014117 and 10-2009-0064642, respectively, the disclosures of which are hereby incorporated by reference.

BACKGROUND OF THE INVENTION

1. Field of the Invention

The present invention relates to a display method and apparatus, and more particularly to a display method and apparatus which can control the brightness of a light source provided in a micro projector.

2. Description of the Related Art

During a conference or a presentation, a projector is often used to convert an image signal received from an image supply device, such as a computer, into projection light and to project the light onto a screen or a white board. Such a projector may be provided with a transmissive Liquid Crystal Display (LCD), a reflective LCD, a Digital Micromirror Device (DMD), and a light source, and projects an image to be displayed by representing in grayscale through control of an alignment angle of liquid crystals provided in the LCD, or adjustment of an on/off time of the DMD, and by simultaneously controlling the light source. The projector requires large amounts of electric power, and generates a great amount of heat due to the power consumption. Accordingly, extensive research is being conducted into reducing the power consumption of a projector. Particularly, in the case of applying a projector to a portable terminal, the power consumption of 1~2 Watts exerts a fatal influence upon the heat generation.

In the case of a Liquid Crystal Display having an LCD panel and a backlight as a light source, a method for adjusting the luminance of the backlight and the luminance of the LCD panel, which are correlated with each other, after analyzing values of red, green, and blue color components of pixels of the display data, has been used. Specifically, according to this method, the luminance of the backlight and the luminance of the LCD panel are adjusted based on the maximum grayscale value that is confirmed by computing a luminance (Y) signal, or based on the maximum grayscale value having the largest value among the confirmed maximum grayscale values of Red (R), Green (G), and Blue (B) colors.

Although the method of adjusting the luminance of the backlight and the luminance of the LCD panel of the Liquid Crystal Display can be applied to a projector, use of the maximum grayscale value of the luminance (Y) signal may cause data loss in the actual RGB signals to generate color errors. Also, in the case of using the maximum grayscale value having the largest value among the maximum grayscale values of RGB colors, only the maximum grayscale value is used, and thus in the case of an image having severe monochromaticity among RGB colors, the maximum grayscale value approaches the threshold grayscale value (e.g. 255) to result in almost no power saving effect on the projection.

Accordingly, there is a need for schemes for reducing the power consumption and the amount of heat generated in driving the light source.

SUMMARY OF THE INVENTION

Accordingly, the present invention has been made to solve at least the above-mentioned problems occurring in the prior art, and an object of the present invention is to provide a projection type display method and apparatus which can effectively control gains of color signals without color error generation and the brightness of a light source in consideration of the distribution of the color signals of image data.

In accordance with an aspect of the present invention, there is provided a method of displaying image data, which includes analyzing histograms by color signals of an input image frame; confirming grayscales by color signals in a predetermined frame unit with reference to the analyzed histograms; determining dimming factors in consideration of maximum grayscale values of the grayscales; determining image gains of the image data by color signals using the determined dimming factors; and outputting an image signal by applying the image gains to the input image and applying the dimming factors to a light source.

In accordance with another aspect of the present invention, there is provided a display apparatus including a light source unit providing light required to drive the display device; a light source driving unit providing driving signals of the light source unit; an image conversion unit converting image data into color signals of a predetermined format; a display panel controlling grayscales of respective pixels constituting the image data; a panel driving unit supplying driving signals of the display panel; and a control unit confirming dimming factors by color signals of image frames by analyzing histograms by color signals of the respective image frames, outputting signals for controlling the brightness of the light source to the light source driving unit through reflection of the dimming factors, setting image data gains by color signals in consideration of the dimming factors, and providing the color signals in which the gains are reflected to the panel driving unit.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION OF THE EXEMPLARY EMBODIMENT

Hereinafter, embodiments of the present invention will be described with reference to the accompanying drawings. In the following description, a detailed description of known functions and configurations incorporated herein will be omitted when it may make the subject matter of the present invention rather unclear.

In an embodiment of the present invention, image data is provided with a plurality of image frames. Each image frame is provided with a specified number of pixels, and each pixel is represented by color signals. That is, the color signals are implemented to represent colors of respective pixels included in an image frame, and are exemplified by R, G, and B signals. Also, in an embodiment of the present invention, an image indicates an image of an actual output, a person, a thing, a background, or the like.

Figure 1:
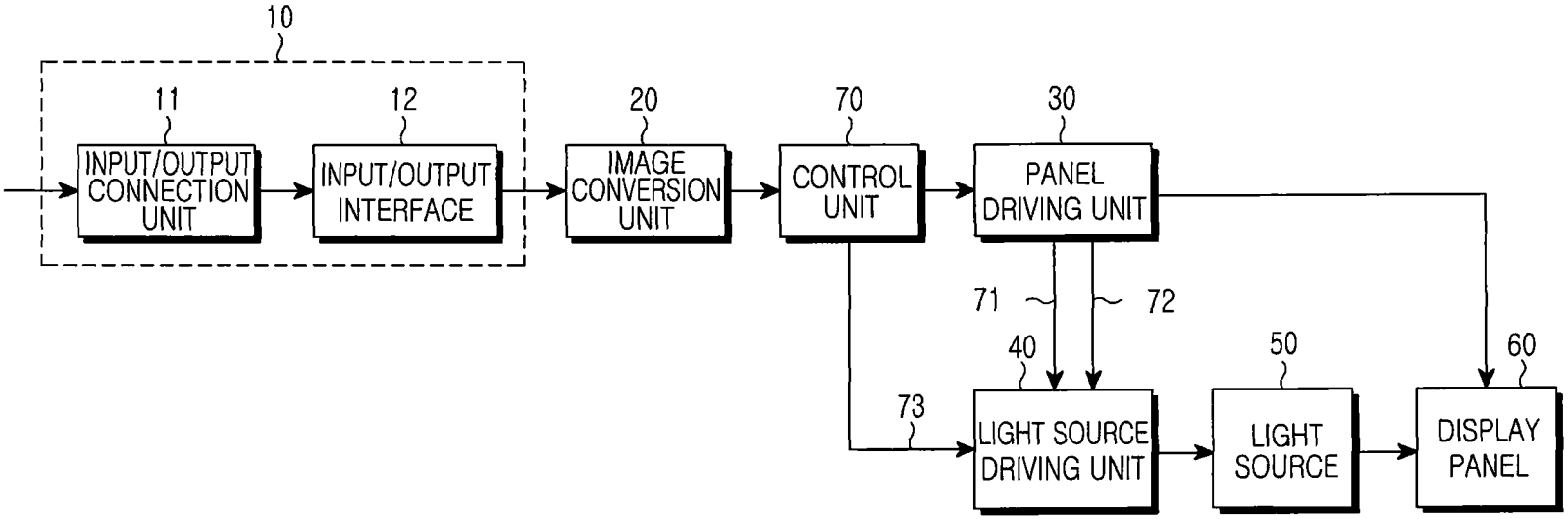
FIG. 1 is a block diagram illustrating the configuration of a display apparatus according to an embodiment of the present invention.

FIG. 1 is a block diagram illustrating the brief configuration of a display apparatus according to an embodiment of the present invention.

Referring to FIG. 1, a display apparatus according to an embodiment of the present invention includes an input/output unit 10, an image conversion unit 20, a panel driving unit 30, a light source driving unit 40, a light source 50, a display panel 60, and a control unit 70.

The input/output unit 10 is provided with an input/output connection unit 11 that includes a Universal Service Bus (USB) terminal, a D-subminature (D-SUB) terminal, Separated-Video (S-Video) terminal, a Radio Corporation of America (RCA) terminal, and a High-Definition Multimedia Interface (HDMI), which are to input/output image data with external appliances. The input/output unit 10 is also provided with an input/output interface 12 connected between the input/output connection unit 11 and the image conversion unit 20 to transfer the input image data to the image conversion unit 20.

In the present invention, the image data is provided with a plurality of image frames which are serially arranged in a specified time unit (e.g. 1/30 sec).

The image conversion unit 20 converts the input image data into an image signal of a specified format, and then converts the image signal into color signals, which can be actually represented through pixels provided in the display panel, in consideration of the output resolution of the display apparatus, the configuration of the display panel pixels, the size of the image frame, and the like. For example, the color signals may be RGB signals.

The panel driving unit 30 generates drive signals for driving the pixels provided in the display panel 60 so that the pixels represent the color signals. Also, the panel driving unit 30 generates and provides a control signal for controlling the operation of a plurality of light emitting devices provided in the light source 50 to the light source driving unit 40. The control signals for controlling the operation of the plurality of light emitting devices are transferred to the light source driving unit 40 through a first light source control path 71 and a second light source control path 72.

The light source 50 generates and provides light required for driving the display apparatus to the display panel 60. For example, the light source 50 may be provided with a plurality of light emitting devices that emit different colors (i.e. red (R), green (G), and blue (B) colors), and the plurality of the light emitting devices may be driven based on a RGB sequential driving method.

Figure 2:
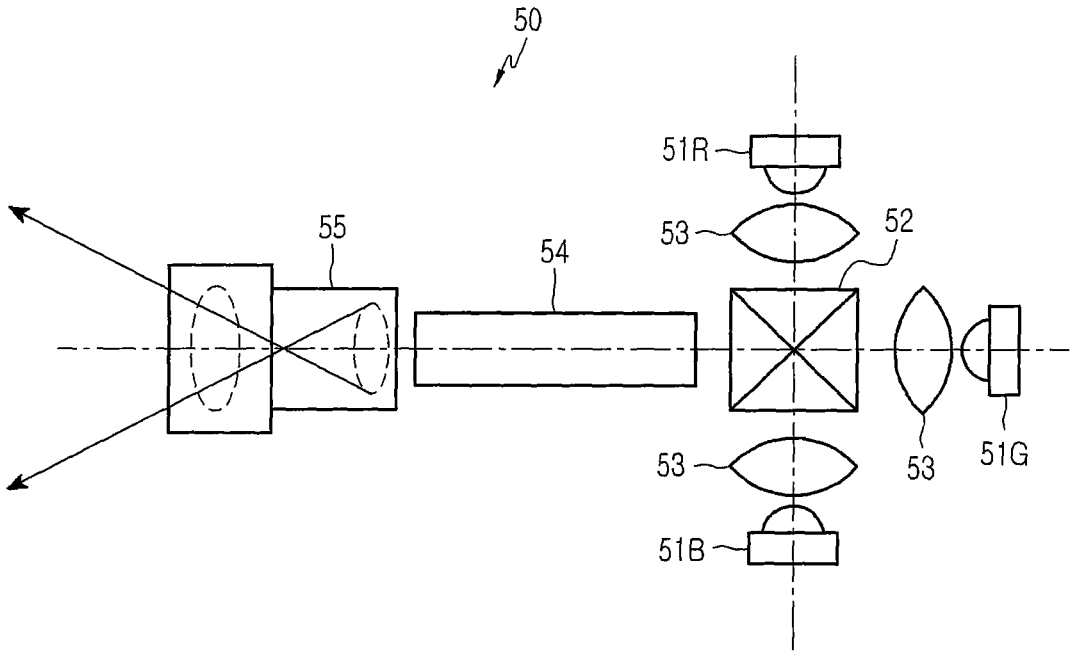
FIG. 2 a diagram illustrating the detailed configuration of a light source provided in a display apparatus according to an embodiment of the present invention.

FIG. 2 is a diagram illustrating the detailed configuration of a light source provided in a display apparatus according to an embodiment of the present invention.

Referring to FIG. 2, the light source 50 provided in the display apparatus according to an embodiment of the present invention is provided with a tetragonal dichroic mirror 52, a plurality of light emitting devices 51R, 51G, and 51B arranged on three sides of the dichroic mirror 52 to emit red, green, and blue colors, respectively, and a condenser lens 53 provided between the dichroic mirror 52 and each of the plurality of light emitting devices 51R, 51G, and 51B. The light signals emitted from the plurality of light emitting devices 51R, 51G, and 51B are combined through the dichroic mirror 52, and output through one side of the dichroic mirror 52. The light source 50 is provided with a light tunnel 54 generating uniform light flux by guiding the output light, and a lens unit 55 diverging the light flux at specified angle (e.g. 30°).

In one embodiment of the present invention, although the detailed construction of the light source is exemplified, the present invention is not limited thereto, and it is apparent that the construction of the light source can be diversely modified by one of ordinary skill in the art to which the present invention pertains. For example, as an alternative of the plurality of light emitting devices that emit different colors (i.e. R, G, and B colors), light emitting devices that emit monochrome light (e.g. white light) may be adopted. Also, a color wheel may be provided between the light source 50 and the display panel 60 so that different colors (i.e. R, G, and B colors) can be provided to the display panel 60 based on an RGB sequential driving method.

Turning back to FIG. 1, the display panel 60 is provided with a plurality of light reflection units (or light transmission units) corresponding to the resolution. The light reflection units (or light transmission units) adjust the grayscales of output light through adjustment of the degree of light reflection (or light transmission) of the light incident from the light source 50.

For example, the display panel 60, which is a Digital Micromirror Device (DMD) panel, can control the angle of the light reflection units provided therein in accordance with a signal input from the panel driving unit, and can control the grayscales of the output light by reflecting the light incident from the light source 50 through the light reflection units.

Also, as an alternative of the DMD panel, the display panel 60 may be a Liquid Crystal Display (LCD) panel or a Liquid Crystal on Silicon (LCoS) panel, which can adjust the grayscales of the output light by controlling the alignment angle of liquid crystals in accordance with the signal input from the panel driving unit 30.

The control unit 70 is connected to the input/output unit 10, the image conversion unit 20, the panel driving unit 30, and the light driving unit 40 to provide control signals for controlling the above function units 10, 20, 30, and 50. The control unit 70 is connected to a key input unit (not illustrated) provided with various kinds of buttons, including a power button, receives signals input from the keyboard, and controls the respective function units 10, 20, 30, and 50 for operation corresponding to the received signals. For example, the control unit 70 controls the image conversion unit 20, the panel driving unit 30, and the light source driving unit 40 in order to display the resolution of the device, an operation control menu, the operation state of the device, and various kinds of guide messages in response to the input from the key input unit.

The control unit 70 confirms gains of image data by color signals through analysis of the respective color signals (e.g.

R, G, and B signals) included in the plurality of image frames input through the image conversion unit 20, and generates signals for controlling brightness levels of the light source that correspond to the respective color signals.

It is desirable that the control unit 70 analyzes histograms by color signals of the respective image frames, confirms the maximum grayscale values of grayscales of the respective color signals, and then confirms dimming factors for controlling the brightness of the light source by dividing the maximum value in a grayscale range by the maximum grayscale values of the grayscales. The control unit 70 determines duty rates of Pulse Width Modulation (PWM) signals for controlling the brightness of the light source in consideration of the dimming factors, and then provides the PWM signals for controlling the brightness of the light source to the light source driving unit 40 through a third light source control path 73. Accordingly, the light source driving unit 40 controls the brightness levels of the plurality of light emitting devices (e.g. 51R, 51G, and 51B in FIG. 5) provided in the light source 50.

Also, the control unit 70 confirms the gains of the respective color signals in consideration of relations between the brightness ΦM of the light source and the output value Vin of image data, reflects the confirmed gains in the image data of the respective color signals, and provides the image data of the respective color signals for representing the color signals by pixels of the panel to the panel driving unit 30.

Figure 3:
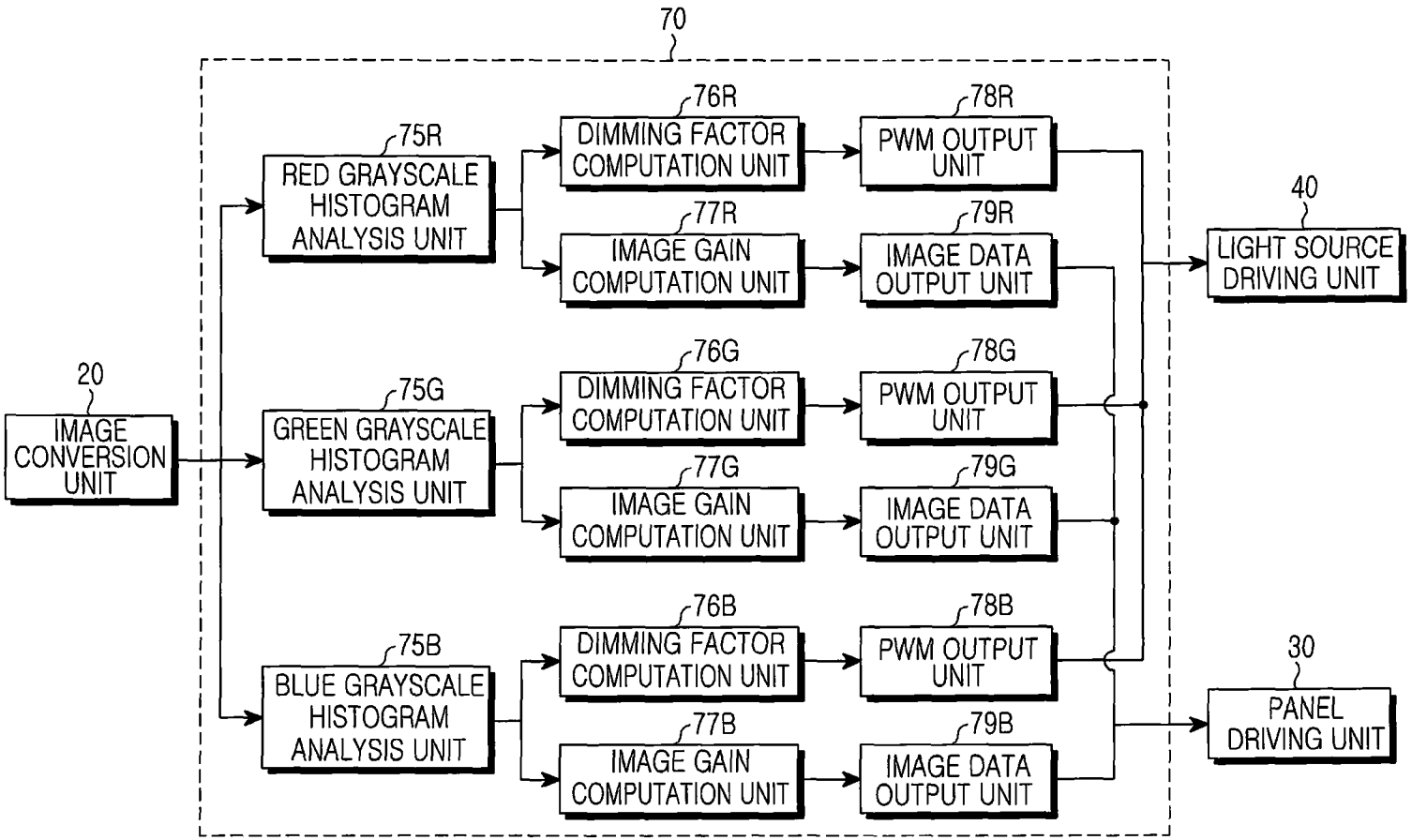
FIG. 3 is a block diagram illustrating the detailed configuration of a control unit provided in a display apparatus according to an embodiment of the present invention.

FIG. 3 is a block diagram illustrating the detailed configuration of a control unit provided in a display apparatus according to an embodiment of the present invention.

The control unit 70 includes histogram analysis units 75R, 75G, and 75B, dimming factor computation units 76R, 76G, and 76B, image gain computation units 77R, 77G, and 77B, PWM output units 78R, 78G, and 78B, and image data output units 79R, 79G, and 79B.

Figure 4A:
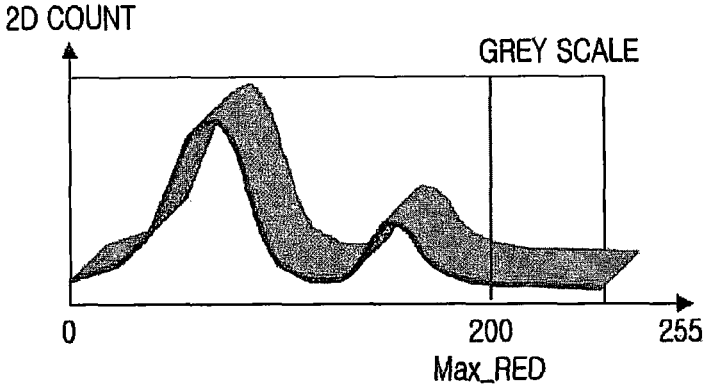
FIGS. 4A to 4C are graphs showing grayscales confirmed by a control unit provided in a display apparatus according to an embodiment of the present invention.
Figure 4B:
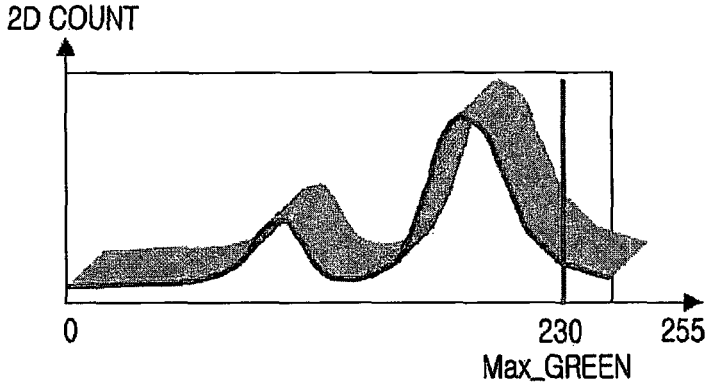
Figure 4C:
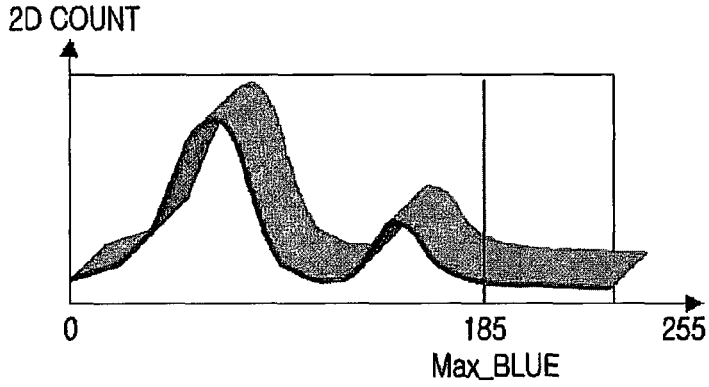

The histogram analysis units 75R, 75G, and 75B analyze histograms of the respective color signals (i.e. R, G, and B signals), and confirm maximum grayscale values of the respective color signals of the current image. For example, as shown in FIGS. 4A, 4B and 4C, the red histogram analysis unit 75R analyzes the grayscale value of the red color as shown in the graph of FIG. 4A, and confirms that the maximum grayscale value of the red grayscale is 200. In the same manner, the green histogram analysis unit 75G analyzes the grayscale value of the green color as shown in the graph of FIG. 4B, and confirms that the maximum grayscale value of the green grayscale is 230. The blue histogram analysis unit 75B analyzes the grayscale value of the blue color as shown in the graph of FIG. 4C, and confirms that the maximum grayscale value of the blue grayscale is 185.

The dimming factor computation units 76R, 76G, and 76B receive the maximum grayscale values from the histogram analysis units 75R, 75G, and 75B, which correspond to the respective color signals, and compute dimming factors of the respective color signals using the maximum grayscale values. Specifically, the dimming factor computation units 76R, 76G, and 76B acquire the dimming factors aR, aG, and aB of the respective color signals by dividing the grayscale range by the maximum grayscale values of the respective color signals. That is, the first dimming factor computation unit 76R acquires the dimming factor aR of the red color signal by dividing the maximum value, e.g. 255, in the grayscale range by the maximum grayscale value, e.g. 200, of the red grayscale, the second dimming factor computation unit 76G acquires the dimming factor aG of the green color signal by dividing the maximum value, e.g. 255, in the grayscale range by the maximum grayscale value, e.g. 230, of the green grayscale, and the third dimming factor computation unit 76B acquires the dimming factor aB of the blue color signal by dividing the maximum value, e.g. 255, in the grayscale range by the maximum grayscale value, e.g. 185, of the blue grayscale. The dimming factors aR, aG, and aB acquired by the dimming factor computation units 76R, 76G, and 76B are provided to the image gain computation units 77R, 77G, and 77B and the PWM output units 78R, 78G, and 78B.

On the other hand, the brightness ΦM of the light source and the output value Vin of the image data have relations represented by Equation (1). Accordingly, the image gain computation units 77R, 77G, and 77B compute the image gains GR, GG, and GB of the respective color signals in consideration of relations between the brightness ΦM of the light source and the output value Vin of the image data. The image gain computation units 77R, 77G, and 77B are connected to the dimming factor computation units 76R, 76G, and 76B of the corresponding color signals, respectively, and acquire the image gains GR, GG, and GB of the respective color signals through computation using Equation (2).

$$\Phi M=(V\text{in})\gamma \tag{1}$$

Here, γ is a constant value predetermined in accordance with the output characteristic of the display apparatus.

$$GR=AR1/\gamma$$

$$GG=aG1/\gamma$$

$$GB=aB1/\gamma \tag{2}$$

Here, aR, aG, and aB are dimming factors provided from the dimming factor computation units 76R, 76G, and 76B, respectively.

In an embodiment of the present invention, it is exemplified that the image gains GR, GG, and GB of the respective color signals are computed. However, the present invention is not limited thereto, and the image gain computation units 77R, 77G, and 77B may use reciprocal numbers of the respective dimming factors aR, aG, and aB as the image gains GR, GG, and GB of the respective color signals.

Figure 5:
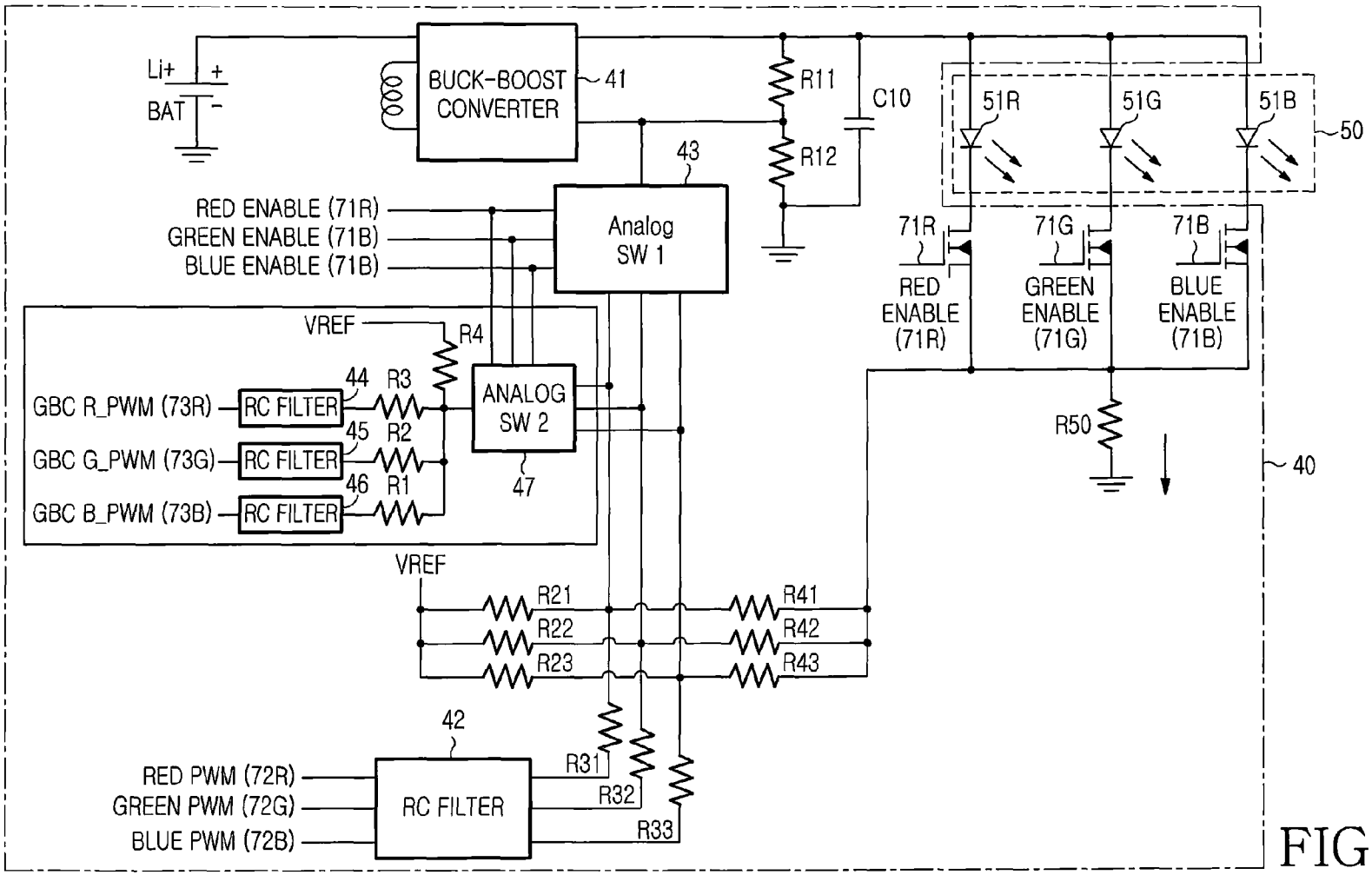
FIG. 5 is a circuit diagram illustrating the detailed configuration of a light source driving unit provided in a display apparatus according to an embodiment of the present invention.

The PWM output units 78R, 78G, and 78B are connected to the dimming factor computation units 76R, 76G, and 76B of the corresponding color signals to receive the dimming factors aR, aG, and aB. The PWM output units compute duty rates of optical signals of the respective color signals, and then output PWM signals GBC R_PWM, GBC G_PWM, and GBC B_PWM (as shown in FIG. 5) for controlling the brightness levels of the light emitting devices through reflection of the duty rates to the light source driving unit 40. As described above, if the maximum grayscale values of the red, green, and blue color signals are 230, 200, and 185, respectively, the optical signal output can be relatively reduced by about 22%, 10%, and 27%, respectively, in comparison to the case in which the output of the light source is not separately controlled.

The image data output units 79R, 79G, and 79B receive the image signal by color signals from the image conversion unit 20, and receive the image gains GR, GG, and GB of the respective color signals from the image gain computation units 77R, 77G, and 77B. Also, the image data output units 79R, 79G, and 79B reflect the respective image gains GR, GG, and GB in the image signal by color signals, and output the reflected image signals to the panel driving unit 30.

The histogram analysis units 75R, 75G, and 75B can confirm the maximum grayscale values of the grayscales of the respective colors through computation of the grayscale values of the respective color signals for each image frame. In order to reduce the data processing amount of the control unit 70, the histogram analysis units 75R, 75G, and 75B can also confirm the maximum grayscale values of the grayscales of the respective colors by computing an average value of the grayscales of the respective color signals of a plurality of image frames (e.g. five image frames). In response to this, the operations of the dimming factor computation units 76R, 76G, and 76B, the image gain computation units 77R, 77G, and 77B, the PWM output units 78R, 78G, and 78B, and the image data output units 79R, 79G, and 79B are controlled, and the output values of the PWM output units 78R, 78G, and 78B and the image data output units 79R, 79G, and 79B can be updated for the plurality of image frames.

FIG. 5 is a circuit diagram illustrating the detailed configuration of a light source driving unit provided in a display apparatus according to an embodiment of the present invention.

Referring to FIG. 5, the light driving unit 40 according to an embodiment of the present invention is provided with a power supply unit that includes a battery BAT, a buck-boost converter 41, resistors R11 and R12, and a capacitor C10. The power supply unit, composed of BAT, 41, R11, R12, and C10, is connected to the red, green, and blue light emitting devices 51R, 51G, and 51B to supply power required to drive the light emitting devices 51R, 51G, and 51B.

The light source driving unit 40 receives operation signals RED ENABLE, GREEN ENABLE, and BLUE ENABLE of the red, green, and blue light emitting devices 51R, 51G, and 51B through first light source control paths 71R, 71G, and 71B connected to the panel driving unit 30. The light source driving unit 40 is provided with a circuit that provides the input operation signals RED ENABLE, GREEN ENABLE, and BLUE ENABLE to the power supply unit, composed of BAT, 41, R11, R12, and C10, through a first analog switch 43.

Also, the light source driving unit 40 receives pulse width modulation (PWM) signals RED PWM, GREEN PWM, and BLUE PWM for controlling the outputs of the red, green, and blue light emitting devices 51R, 51G, and 51B through second light source control paths 72R, 72G, and 72B connected to the panel driving unit 30. The signals for controlling the outputs of the light emitting devices 51R, 51G, and 51B are signals for controlling the basic brightness of the red, green, and blue light emitting devices 51R, 51G, and 51B, and will hereinafter be referred to as "light output control signals."

The light source driving unit 40 is provided with a circuit that provides the input light output control signals RED PWM, GREEN PWM, and BLUE PWM to the power supply unit, composed of BAT, 41, R11, R12, and C10, through an RC filter 42, resistors R31, R32, and R33, and the first analog switch 43. The light source driving unit 40 is also provided with a circuit that provides the input light output control signals RED PWM, GREEN PWM, and BLUE PWM to cathode terminals of the red, green, and blue light emitting devices 51R, 51G, and 51B through the RC filter 42 and resistors R31, R32, R33, R41, R42, and R43.

Also, the light source driving unit 40 receives signals GBC R_PWM, GBC G_PWM, and GBC B_PWM for controlling the brightness levels of the light emitting devices through third light source control paths 73R, 73G, and 73B. The light source driving unit 40 is provided with a circuit for providing the signals GBC R_PWM, GBC G_PWM, and GBC B_PWM for controlling the brightness levels of the light emitting devices to the first analog switch 43 through RC filters 44, 45, and 46, resistors R1, R2, and R3, and a second analog switch 47.

Figure 6:
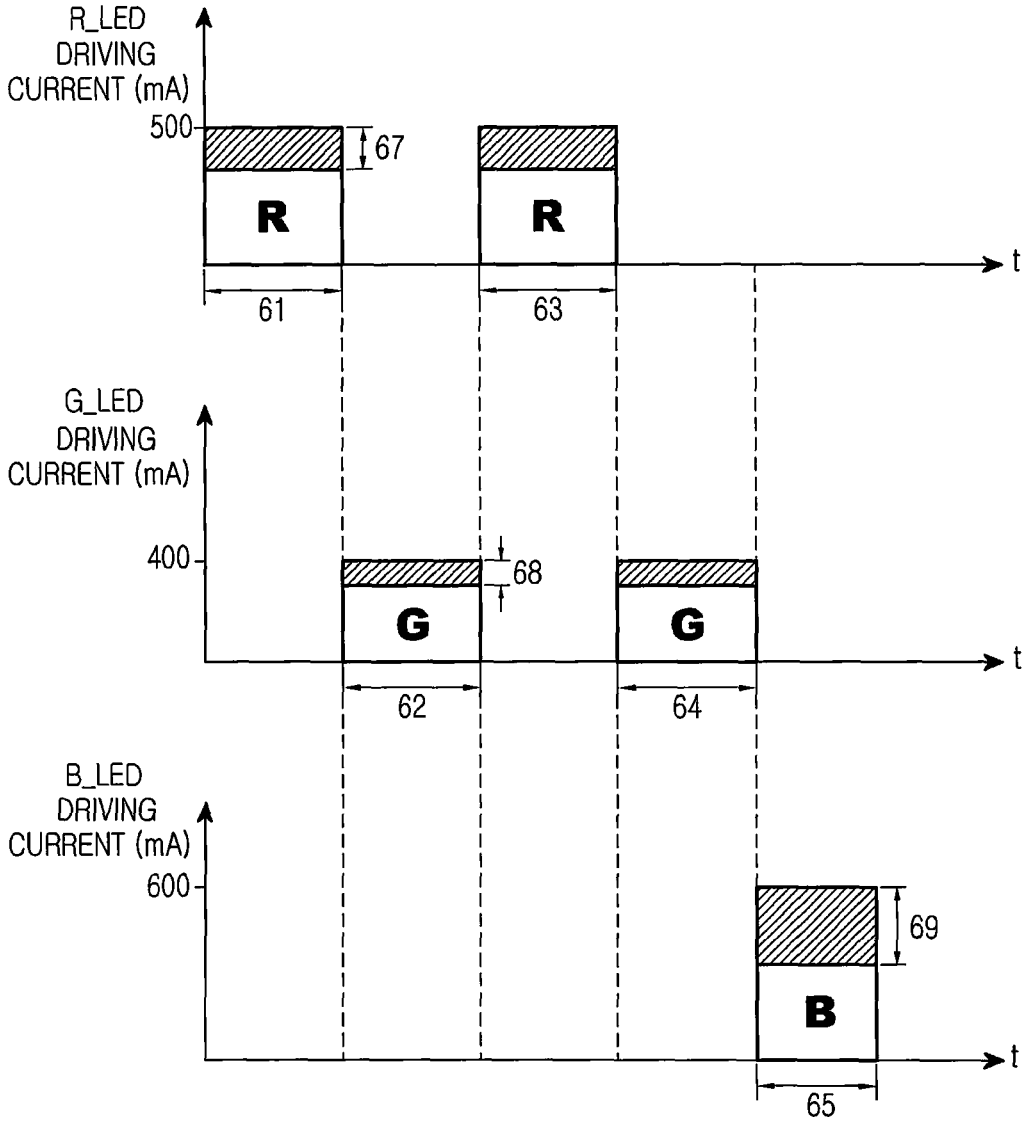
FIG. 6 is a diagram showing signal timing for controlling the brightness levels of light emitting devices output by PWM output units of FIG. 3.

FIG. 6 is a diagram showing the timing of the signals GBC R_PWM, GBC G_PWM, and GBC B_PWM for controlling the brightness levels of the light emitting devices which are output by the PWM output units 78R, 78G, and 78B of the control unit provided in the display apparatus according to an embodiment of the present invention. The signal GBC R_PWM for controlling the brightness level of the red light emitting device is output in first and third periods 61 and 63, the signal GBC G_PWM for controlling the brightness level of the green light emitting device is output in second and fourth periods 62 and 64, and the signal GBC B_PWM for controlling the brightness level of the blue light emitting device is output in a fifth period 65. If the maximum grayscale values of the histograms of the red, green, and blue signals are 230, 200, and 185, respectively, the dimming factors aR, aG, and aB are confirmed through reflection of the maximum grayscale values, and the PWM signals for controlling the brightness levels of the light emitting devices are output through reduction of the duty rates as high as the confirmed dimming factors. Accordingly, the driving current of the respective light emitting devices can be relatively reduced as large as the corresponding sizes 67, 68, and 69 in comparison to the case in which the output of the light source is not separately controlled.

In an embodiment of the present invention, although it is exemplified that the third light source control paths 73R, 73G, and 73B are plural paths provided to transfer the signals GBC R_PWM, GBC G_PWM, and GBC B_PWM for controlling the brightness levels of the light emitting devices, the present invention is not limited thereto. For example, in the case in which the PWM output units 78R, 78G, and 78B of the control unit output the signals GBC R_PWM, GBC G_PWM, and GBC B_PWM for controlling the brightness levels of the light emitting devices in an RGB sequential driving method, it is also possible to output the signals GBC R_PWM, GBC G_PWM, and GBC B_PWM for controlling the brightness levels of the light emitting devices using a single path at the output timing of the corresponding control signals.

Figure 7:
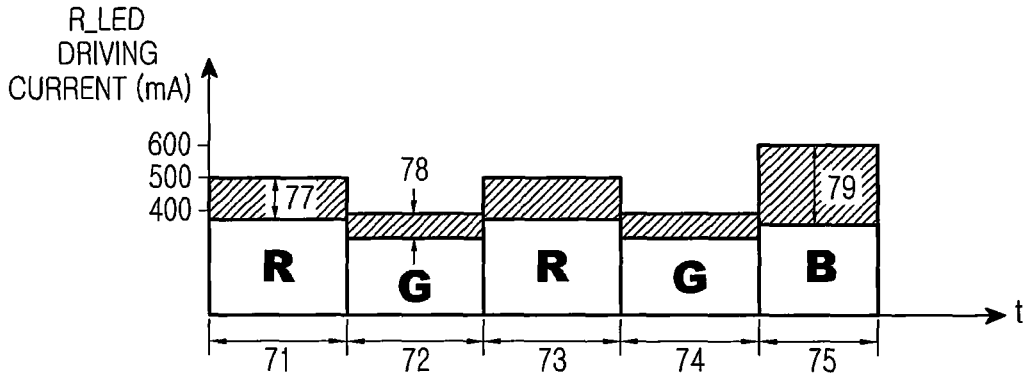
FIG. 7 is a diagram showing signal timing for controlling the brightness levels of light emitting devices output by PWM output units of FIG. 3.

FIG. 7 is a diagram showing the timing of the signals GBC R_PWM, GBC G_PWM, and GBC B_PWM for controlling the brightness levels of the light emitting devices which are output by the PWM output units 78R, 78G, and 78B of the control unit provided in the display apparatus according to an embodiment of the present invention.

The timing diagram as illustrated in FIG. 7 exemplifies a case where the PWM output units 78R, 78G, and 78B of the control unit outputs the GBC R_PWM, GBC G_PWM, and GBC B_PWM signals for controlling the brightness levels of the light emitting devices in an RGB sequential driving method. Referring to FIG. 7, the GBC R_PWM, GBC G_PWM, and GBC B_PWM signals for controlling the brightness levels of the light emitting devices are output through a single path in the RGB sequential driving method.

In the same manner as the timing diagram illustrated in FIG. 6, the signal GBC R_PWM for controlling the brightness level of the red light emitting device is output in first and third periods 71 and 73, the signal GBC G_PWM for controlling the brightness level of the green light emitting device is output in second and fourth periods 72 and 74, and the signal GBC B_PWM for controlling the brightness level of the blue light emitting device is output in a fifth period 75. Accordingly, the driving current of the respective light emitting devices can be relatively reduced as large as the corresponding sizes 77, 78, and 79 in comparison to the case in which the output of the light source is not separately controlled.

Figure 8:
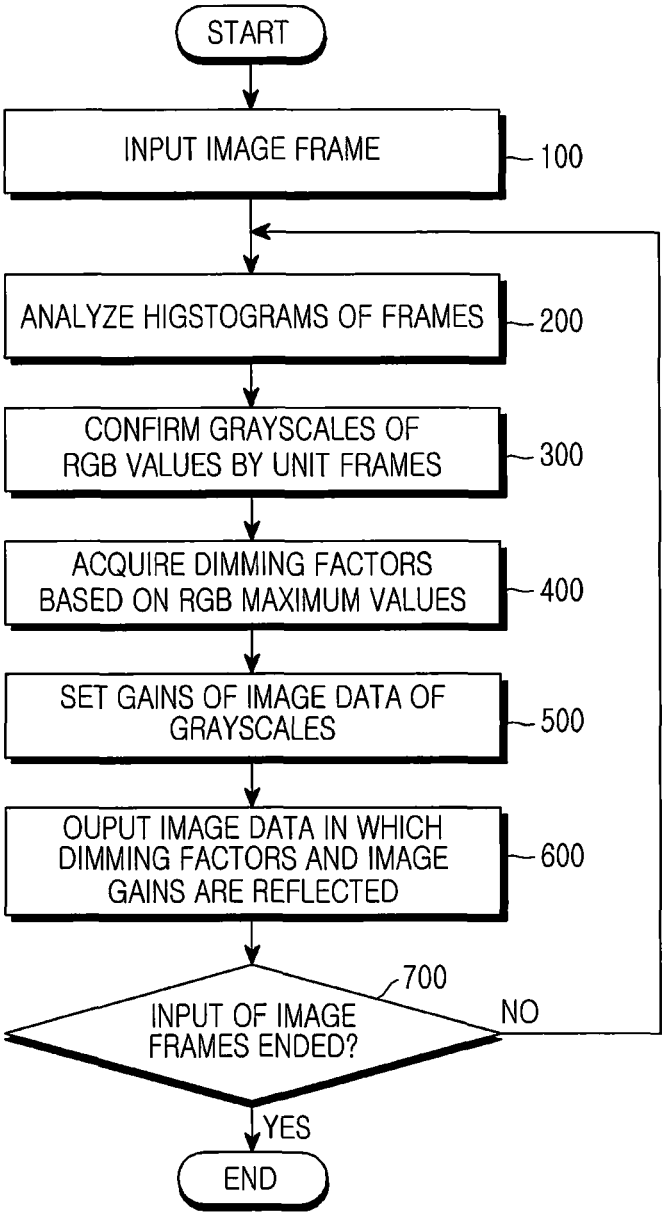
FIG. 8 is a flowchart illustrating a method of displaying image data according to an embodiment of the present invention.

FIG. 8 is a flowchart illustrating a method of displaying image data according to an embodiment of the present invention.

According to the method of displaying image data according to an embodiment of the present invention, image data including a plurality of frames are received from an outside in step 100, and histogram values for the color distribution included in the respective input frames are extracted in step 200.

Then, based on the histograms extracted by frames, grayscales by colors (e.g. red, green, and blue) of the respective frames are confirmed, and grayscale values by unit frame of the gray scales (e.g., red, green, and blue grayscales as illustrated in FIGS. 4A, 4B, and 4C) are extracted in step 300. In step 300, the maximum grayscale values of the grayscale values by unit frame of the respective color signals are computed.

Further, in step 300, a unit frame may be set to one image frame, and the maximum grayscale values of the grayscale values are individually computed with respect to the respective image frames. Although the maximum grayscale values individually computed with respect to the frames may be used in steps 400 to 700, a plurality of frames are set to one frame to reduce the data processing amount. For example, five frames are set to one frame, grayscales by color signals of the respective frames are extracted, and the maximum grayscale value of the grayscales by unit frames of the respective color signals are computed by averaging the extracted values.

In step 400, the dimming factors aR, aG, and aB of the respective color signals are acquired using the grayscale values by unit frames of the respective color signals (e.g. red, green, and blue color signals) extracted in step 300. The dimming factors can be acquired by dividing the grayscale range by the maximum grayscale values of the respective color signals. That is, the dimming factor aR of the red color signal is acquired by dividing the maximum value, e.g. 255, in the grayscale range by the maximum grayscale value, e.g. 200, of the red grayscale, the dimming factor aG of the green color signal is acquired by dividing the maximum value, e.g. 255, in the grayscale range by the maximum grayscale value, e.g. 230, of the green grayscale, and the dimming factor aB of the blue color signal is acquired by dividing the maximum value, e.g. 255, in the grayscale range by the maximum grayscale value, e.g. 185, of the blue grayscale.

In step 500, the image gains GR, GG, and GB of the respective color signals are acquired in consideration of relations between the brightness ΦM of the light source and the output value Vin of the image data as expressed in Equation (1).

In an embodiment of the present invention, a method of computing the image gains GR, GG, and GB of the respective color signal is exemplified. However, the present invention is not limited thereto, and for example, reciprocal numbers of the respective dimming factors aR, aG, and a may be used as the image gains GR, GG, and GB of the respective color signals.

Then, in step 600, the image gains GR, GG, and GB are reflected in the image data of the respective color signals, and the brightness is controlled by reflecting the dimming factors aR, aG, and aB in the brightness of the RGM light emitting devices provided as the light source to output the image data. Specifically, in order to reflect the dimming factors aR, aG, and aB of the respective color signals determined through step 400 in the RGB light emitting devices provided as the light source, the outputs of the RGB light emitting devices provided as the light source are controlled through the PWM signals that reflect the dimming factors aR, aG, and aB of the respective color signals. Also, by multiplying the RGB values of the image data input by color signals by the image gains GR, GG, and GB acquired in step 500, the output light of a light reflection unit (or light transmission unit) is adjusted. Consequently, in step 600, the light emitting devices emit light with a controlled brightness by reflecting the grayscales of the color signals, and the output light of the light reflection unit (or optical transmission unit) is adjusted by reflecting the image gains GR, GG, and GB, so the image data composed of a plurality of pixels is displayed on a screen.

Finally, in step 700, it is confirmed whether the input of the image frame is completed. If the input of the image frame is completed, the output of the image data of the display apparatus is ended, while if not, steps 200 to 600 are repeatedly performed to output the image data.

As described above, according to the image data display method and apparatus according to the present invention, the power consumption required to drive the display apparatus can be reduced by reducing the brightness of the light source according to the color distribution of the image data and simultaneously increasing the gain values of the color signals. Also, by inclusively performing brightness control with respect to the respective R, G, and B signals, a natural image can be displayed without color error occurrence.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A method of displaying image data, comprising the steps of:

analyzing histograms of color signals of an input image frame;

confirming a plurality of grayscales respectively corresponding to a plurality of the color signals in a predetermined frame unit with reference to the analyzed histograms;

determining a plurality of dimming factors respectively corresponding to the plurality of the color signals, based on maximum grayscale values of the plurality of grayscales;

determining a plurality of image gains of the image data respectively corresponding to the plurality of the color signals using the plurality of dimming factors; and outputting an image signal by applying the plurality of image gains and the plurality of dimming factors to the input image.

2. The method as claimed in claim 1, wherein the plurality of dimming factors are determined by dividing a maximum value in a grayscale range by the maximum grayscale values of the plurality of grayscales.

3. The method as claimed in claim 1, wherein the plurality of image gains are reciprocal numbers of the respective dimming factors.

4. The method as claimed in claim 1, wherein the plurality of image gains are computed based on relations between the brightness of a light source and an output of the image data.

5. The method as claimed in claim 1, wherein the step of confirming the plurality of grayscales comprises:

confirming the plurality of grayscales respectively corresponding to the plurality of the color signals of the image frame;

determining at least two image frames in a predetermined frame unit;

averaging the plurality of grayscales of the image frames included in the unit to confirm the plurality of grayscales in the unit; and confirming the maximum grayscale values of the plurality of grayscales in the unit.

6. The method as claimed in claim 1, wherein a light source required for display is provided by a color sequential driving method.

7. A display apparatus, comprising:

a light source unit providing light required to drive a display device;

a light source driving unit providing driving signals to the light source unit;

an image conversion unit converting image data into a plurality of color signals of a predetermined format;

a display panel controlling a plurality of grayscales of respective pixels constituting the image data;

a panel driving unit supplying driving signals to the display panel; and a control unit confirming a plurality of dimming factors respectively corresponding to the plurality of color signals of image frames by analyzing a plurality of histograms of the plurality of color signals of the respective image frames, outputting signals for controlling the brightness of the light source to the light source driving unit through reflection of the plurality of dimming factors, setting a plurality of image data gains of the plurality of color signals based on the dimming factors, and providing the plurality of color signals in which the plurality of image data gains are reflected to the panel driving unit.

8. The display apparatus as claimed in claim 7, wherein the control unit determines the plurality of dimming factors by dividing a maximum value in a grayscale range of the plurality of color signals by the maximum grayscale values of the histograms.

9. The display apparatus as claimed in claim 8, wherein the control unit sets reciprocal numbers of the plurality of dimming factors as gain values of the image data of the plurality of color signals.

10. The display apparatus as claimed in claim 8, wherein the control unit sets the gain values of the image data of the plurality of color signals using the plurality of dimming factors based on relations between the brightness of the light source of the plurality of color signals and the image data of the plurality of color signals.

11. The display apparatus as claimed in claim 7, wherein the panel driving unit outputs a first Pulse Width Modulation (PWM) signal for controlling a basic brightness of the image data, and the control unit outputs a second PWM signal for controlling a brightness of the plurality of light emitting devices.

12. The display apparatus as claimed in claim 11, wherein the light source driving unit receives the second PWM signal, and modulates the pulse width of current values being supplied to the plurality of light emitting devices.

13. The display apparatus as claimed in claim 7, wherein the light source unit is driven by a color sequential driving method.

14. The display apparatus as claimed in claim 7, wherein the display panel adjusts the plurality of grayscales of an output light by controlling an incident angle or projection angle of an incident light.

15. The display apparatus as claimed in claim 7, wherein the control unit comprises:

a histogram analysis unit analyzing the plurality of histograms respectively corresponding to the plurality of color signals of the image frames, and confirming the maximum grayscale values of the plurality of grayscales respectively corresponding to the plurality of color signals;

a dimming factor computation unit receiving the maximum grayscale values of the plurality of grayscales from the histogram analysis unit, and confirming the plurality of dimming factors respectively corresponding to the plurality of color signals;

a PWM output unit receiving the plurality of dimming factors respectively corresponding to the plurality of color signals from the dimming factor computation unit, generating and providing signals for controlling the brightness of the light source to the light source driving unit;

an image gain computation unit receiving the plurality of dimming factors from the dimming factor computation unit, and confirming the plurality of image gains respectively corresponding to the plurality of color signals based on relations between the brightness of the light source and the image data of the plurality of color signals; and an image data output unit receiving the plurality of image gains respectively corresponding to the plurality of color signals from the image gain computation unit, reflecting the plurality of image gains respectively corresponding to the plurality of the color signals in the image data of the plurality of color signals, and outputting the reflected image data to the panel driving unit.

* * * * *